US011450242B1

(12) United States Patent
Foegelle

(10) Patent No.: US 11,450,242 B1
(45) Date of Patent: Sep. 20, 2022

(54) POP-OUT FLAG FOR A RETAIL SHELF EDGE

(71) Applicant: Elite Creative Solutions, LLC, Broken Arrow, OK (US)

(72) Inventor: John Foegelle, Broken Arrow, OK (US)

(73) Assignee: Elite Creative Solutions, LLC, Broken Arrow, OK (US)

( * ) Notice: Subject to any disclaimer, the term of this patent is extended or adjusted under 35 U.S.C. 154(b) by 0 days.

(21) Appl. No.: 17/090,587

(22) Filed: Nov. 5, 2020

Related U.S. Application Data

(63) Continuation-in-part of application No. 16/834,700, filed on Mar. 30, 2020, now Pat. No. 10,984,684, which is a continuation of application No. 15/834,867, filed on Dec. 7, 2017, now Pat. No. 10,607,511, which is a continuation-in-part of application No. 15/446,883, filed on Mar. 1, 2017, now abandoned.

(60) Provisional application No. 62/930,869, filed on Nov. 5, 2019, provisional application No. 62/301,958, filed on Mar. 1, 2016.

(51) Int. Cl.

| | |
|---|---|
| ***G09F 3/18*** | (2006.01) |
| ***G09F 3/20*** | (2006.01) |
| ***G09F 17/00*** | (2006.01) |
| ***G09F 3/00*** | (2006.01) |

(52) U.S. Cl.
CPC ..... *G09F 3/204* (2013.01); *G09F 3/0289* (2013.01); *G09F 3/202* (2013.01); *G09F 17/00* (2013.01); *G09F 2017/0033* (2013.01); *G09F 2017/0041* (2013.01)

(58) Field of Classification Search
CPC ..... G09F 3/10; G09F 3/00; G09F 3/02; G09F 2003/023; G09F 3/0288; G09F 2003/0264; B42F 21/04; B42D 9/00; B42D 5/00
See application file for complete search history.

(56) References Cited

U.S. PATENT DOCUMENTS

| | | | | |
|---|---|---|---|---|
| 2,632,269 | A | 3/1953 | Sanders | |
| D245,290 | S | 8/1977 | Kingsford | |
| 4,222,187 | A | 9/1980 | Huck | |
| 4,829,689 | A * | 5/1989 | Alshooler | G09F 1/10 24/295 |
| 5,207,174 | A | 5/1993 | Fabbrini | |
| 5,209,514 | A | 5/1993 | Hebert | |
| 5,848,698 | A | 12/1998 | Stompe | |
| D419,595 | S | 1/2000 | Haas et al. | |
| 6,197,396 | B1 | 3/2001 | Haas et al. | |
| 6,284,338 | B1 | 9/2001 | Bauman et al. | |
| 6,688,649 | B2 | 2/2004 | Casagrande | |

(Continued)

*Primary Examiner* — Cassandra Davis
(74) *Attorney, Agent, or Firm* — GableGotwals

(57) ABSTRACT

A pop-out flag for use along a retail shelf edge is printed on a sheet, with information on the front and back sides of the flag being printed without having to duplex the sheet through the printer. When the flag is removed from the sheet it folds onto itself so that an adhesive trim portion of the front and back sides of the flag come into contact with one another. The pop-out design also allows the liner to remain with the face stock to add necessary stiffness to the flag. A pair of concave, arcuate-shaped reliefs along the fold line permit the flag to fold flat onto itself so that the adhesive trim portion contains no voids or bubbles where the two sides of the flag contact one another.

17 Claims, 16 Drawing Sheets

(56) References Cited

U.S. PATENT DOCUMENTS

| | | | |
|---|---|---|---|
| 7,055,274 | B2 | 6/2006 | Fast et al. |
| 7,534,476 | B2 | 5/2009 | Banks et al. |
| 7,779,569 | B2 | 8/2010 | Riley et al. |
| 8,776,417 | B2 | 7/2014 | Jain et al. |
| 10,607,511 | B1 | 3/2020 | Foegelle |
| 2003/0066219 | A1 | 4/2003 | Palumbo |
| 2006/0257610 | A1 | 11/2006 | Brett |
| 2008/0303265 | A1 | 12/2008 | Kaufman |
| 2011/0214325 | A1 | 9/2011 | Darress |

* cited by examiner

POP-OUT FLAG FOR A RETAIL SHELF EDGE

CROSS-REFERENCE TO PENDING APPLICATIONS

This application claims priority to U.S. Provisional Application No. 62/930,869, filed Nov. 5, 2019, and to U.S. patent application Ser. No. 16/834,700 (continuation), filed Mar. 30, 2020, which claimed priority to U.S. patent application Ser. No. 15/834,867 (continuation-in-part), filed Dec. 7, 2017, U.S. Pat. No. 10,607,511, issued Mar. 31, 2020, which in turn claimed priority to U.S. patent application Ser. No. 15/446,883 (conversion), filed Mar. 1, 2017, which in turn claimed priority to U.S. Provisional Application No. 62/301,958, filed Mar. 1, 2016. All of which are incorporated herein by reference.

BACKGROUND

This disclosure generally relates to retail shelf signage and, in particular, to retail shelf edge flags extending outwardly away from the shelf edge.

Edge flags are blank or pre-printed with non-variable information. This information is first printed on one side of the flag, then the other side. The finished flag is then inserted into a shelf clip. Other flags may be printed on card stock (or left blank and made out of card stock), cut out, and then folded over. However, the front and back sides bow out when inserted into the shelf clip.

SUMMARY

Embodiments of a flag for use along a retail shelf edge is made using a pop-out design arranged on a digital or laser printable sheet so that desired variable information can be printed on the front and back sides of the flag without duplexing the sheet.

The flag's pop-out design eliminates the labor and other difficulties associated with perforated designs. The pop-out design also allows the liner to remain with the face stock to add necessary stiffness to the flag, a beneficial feature for final installation purposes. Once the flag is popped-out of the sheet, the exposed adhesive allows the front and back sides of the flag to fold onto each other. A cross-cut or perforated hole in the flag's tab allows the shelf clip to pierce the folded tag.

In embodiments, a pair of concave, arcuate-shaped reliefs located at opposing ends of the fold line permit the flag to fold flat onto itself so that the adhesive trim portion contains no voids or bubbles where the two sides of the flag contact one another.

Figure 1:
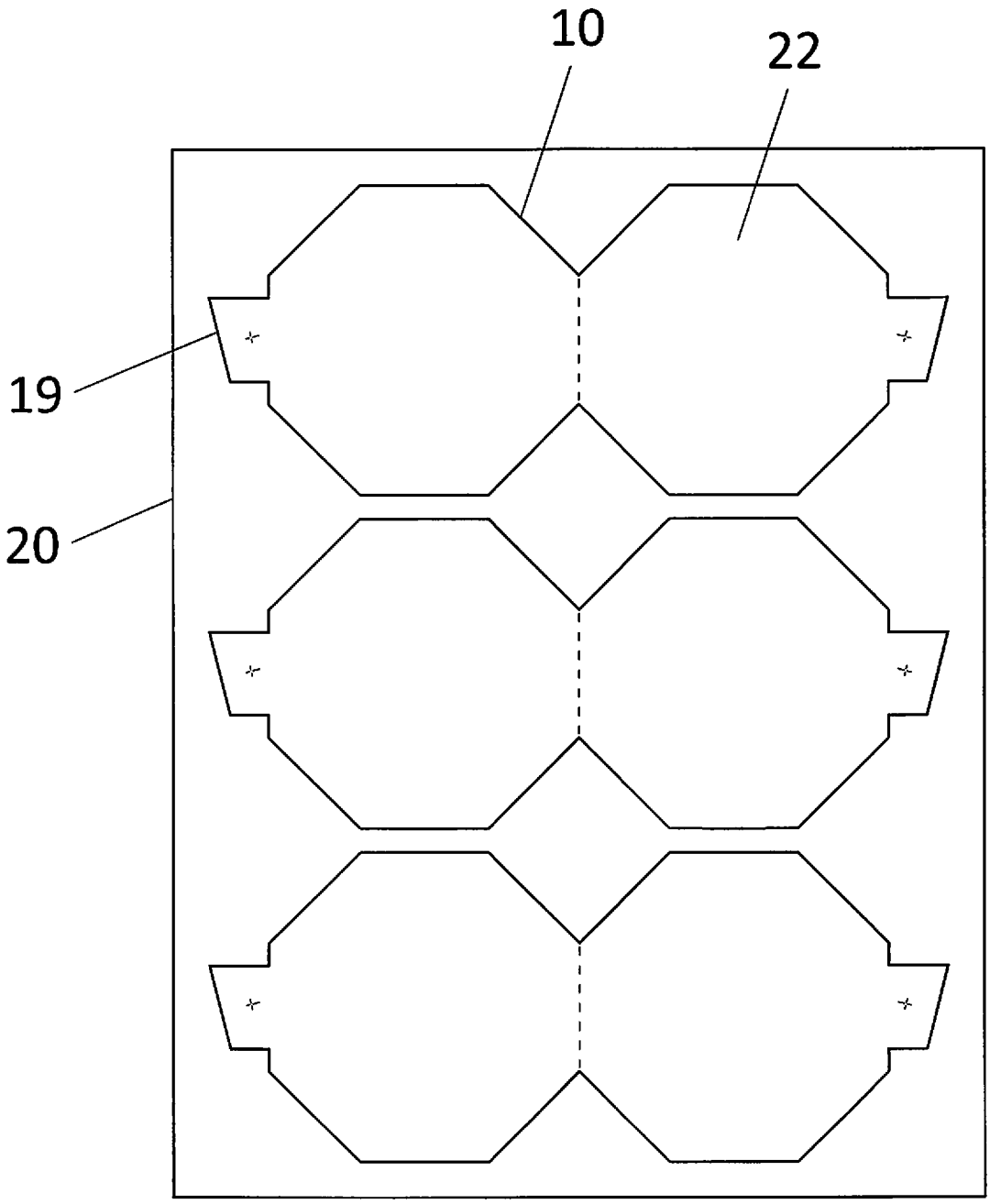
FIG. 1 is an embodiment of the laser printer printable flag arranged on a laser printable sheet.
Figure 2:
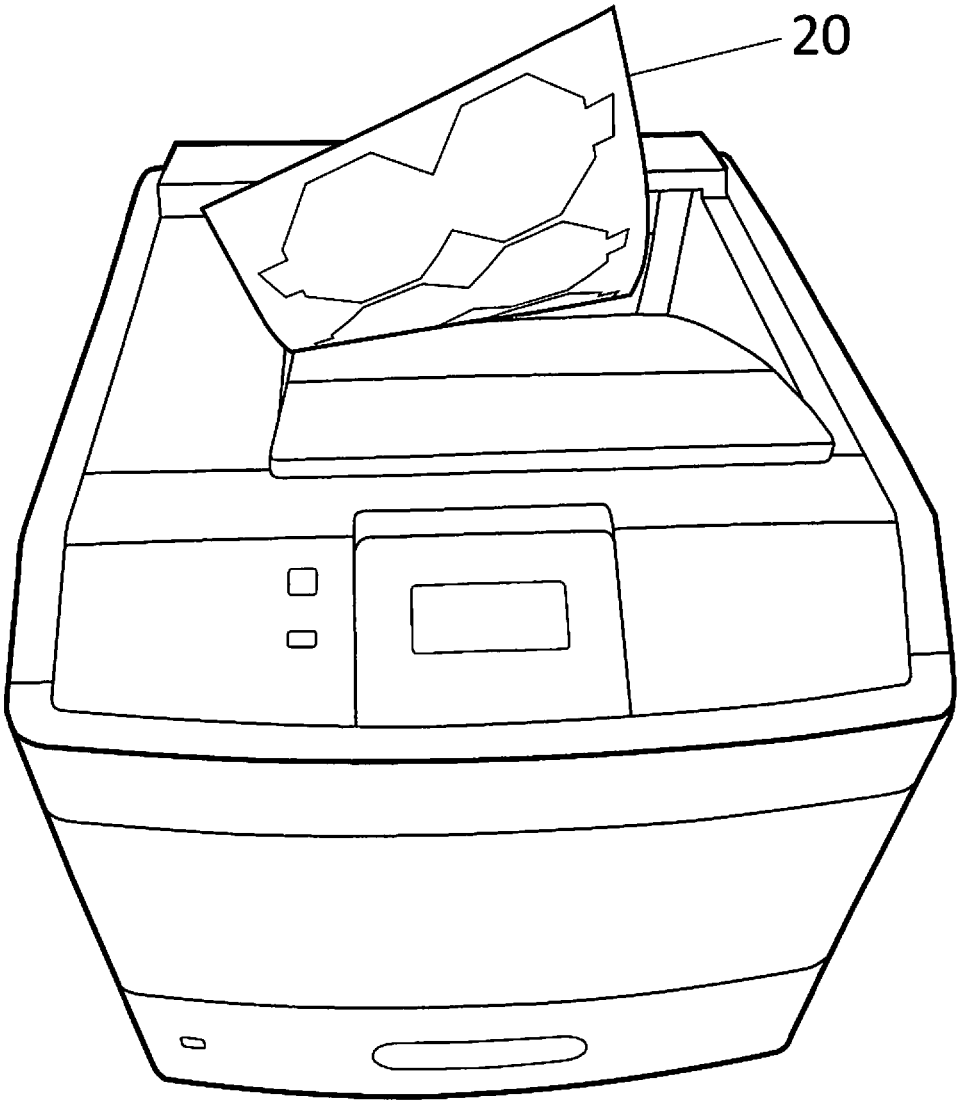
FIG. 2 is an embodiment of the sheet of FIG. 1 as it exits a laser printer. The sheet may also be digitally printed.

| Elements and Numbering used in the Drawings and Detailed Description | |
|---|---|
| 10 | Flag |
| 11 | Front or first side |
| 12 | Front fixed or non-variable print information (first printed information) |
| 13 | Front variable print information (second different printed information) |
| 15 | Back or second side |
| 16 | Back fixed or non-variable print information (first printed information) |
| 17 | Back variable print information (second different printed information) |
| 19 | Tab for hanging |
| 20 | Laser or digital printable sheet |
| 21 | Face stock |
| 22 | Print area (main body of sides 11, 15) |
| 23 | Die cut on face |
| 24 | Void area in sheet |
| 25 | Liner backing |
| 26 | Printed Flag removed from sheet |
| 27 | Back cut in liner |
| 29 | Exposed adhesive trim or border |
| 30 | Perimeter |
| 31 | Perforated hole (cross cut through the liner) |
| 33 | Fold line - crease cut or perforated cut for folding flag |
| 35 | Adhesive layer |
| 37 | Retail shelf edge or fixture |
| 38 | Plastic shelf clip sign holder |
| 41 | Horizontal centerline |
| 43 | Vertical centerline |

-continued

| Elements and Numbering used in the Drawings and Detailed Description | |
|---|---|
| 50 | Relief |
| 51 | First end |
| 53 | Second end |
| 55 | Sides |

DETAILED DESCRIPTION

This description of a printable sheet containing a flag for a retail shelf fixture makes reference to particular means, materials and embodiments, but is not intended to be limited to those particulars. Rather, the sheet extends to all functionally equivalent structures, methods and uses that fall within the scope of the claims that immediately follow the description.

Referring to the drawings, a laser printer printable flag 10 for a retail shelf fixture or edge 37 is made from a laser printable sheet 20 custom cut with a pop-out flag design. The sheet 20 is a 2-ply pressure-sensitive media which includes face stock 21, an adhesive layer 35, and a liner 25. (Adhesive is attached to back of face sheet.) The pop-out design includes a face cut 23 (to the adhesive layer 35) and a back cut 27 (through the liner 25). The distance between the face and back cuts 23, 27 provides an exposed adhesive border 29 around the flag 10 when removed from the sheet 20.

Figure 6:
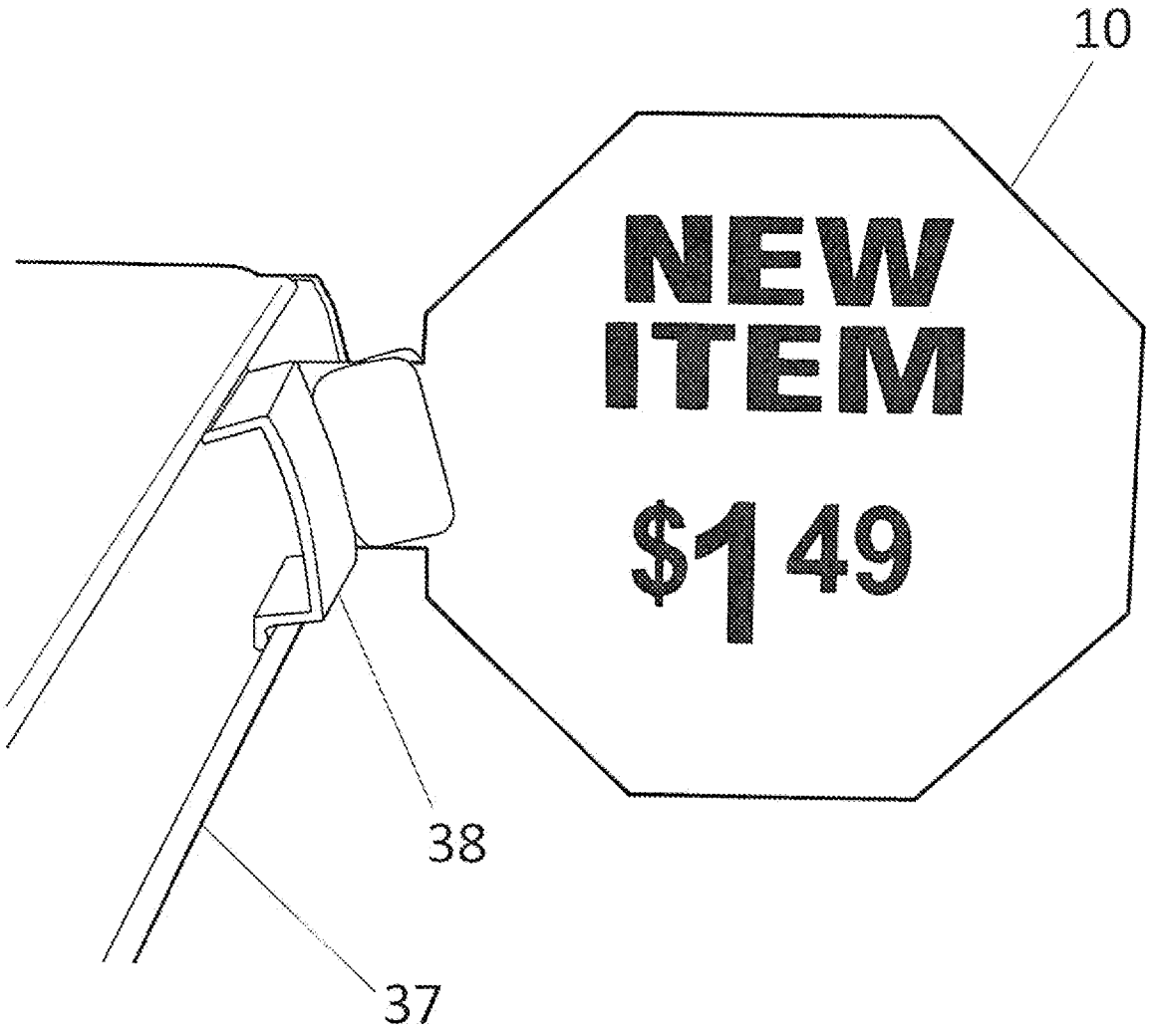
FIG. 6 is an embodiment of the assembled flag inserted into a shelf clip and installed on a shelf edge. A perforated hole in the flag's tab assists in proper positioning and allows the shelf clip to pierce the folded tag. The pop-out design allows the liner to remain with the face stock to add necessary stiffness to the flag.
Figure 7:
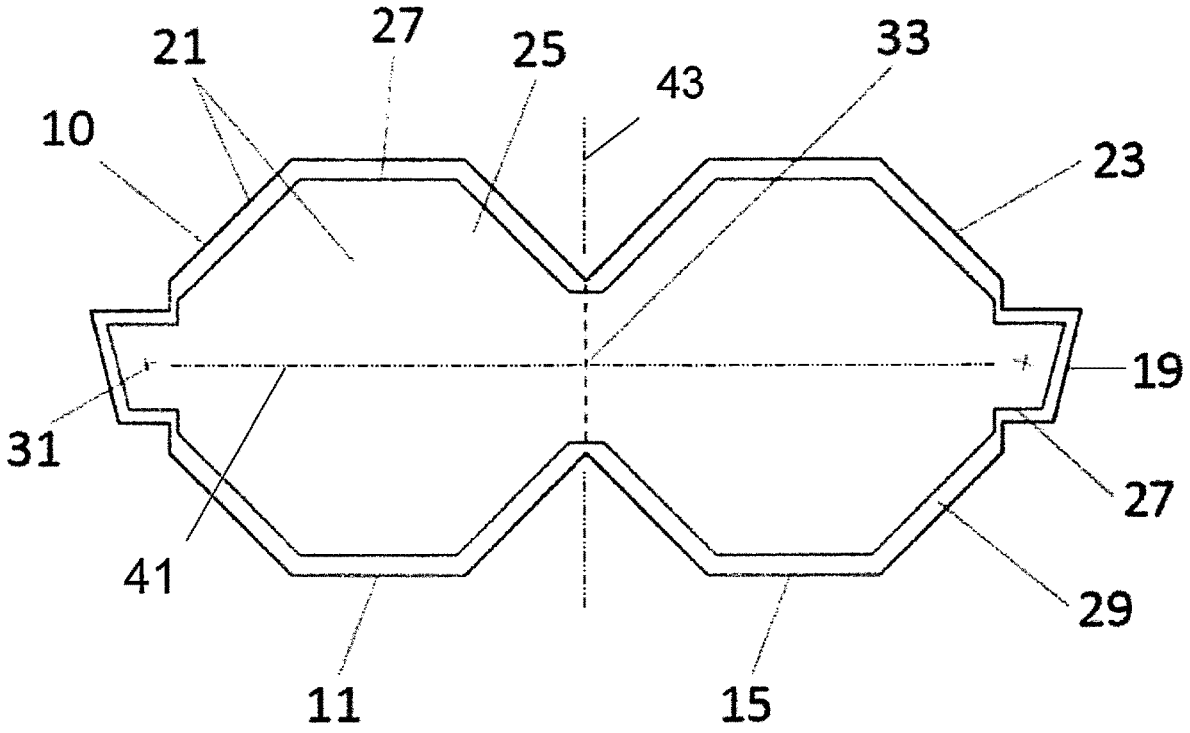
FIG. 7 is an embodiment of the flag's die cut detail when it is removed from the laser printable sheet before folding for use.
Figure 8:
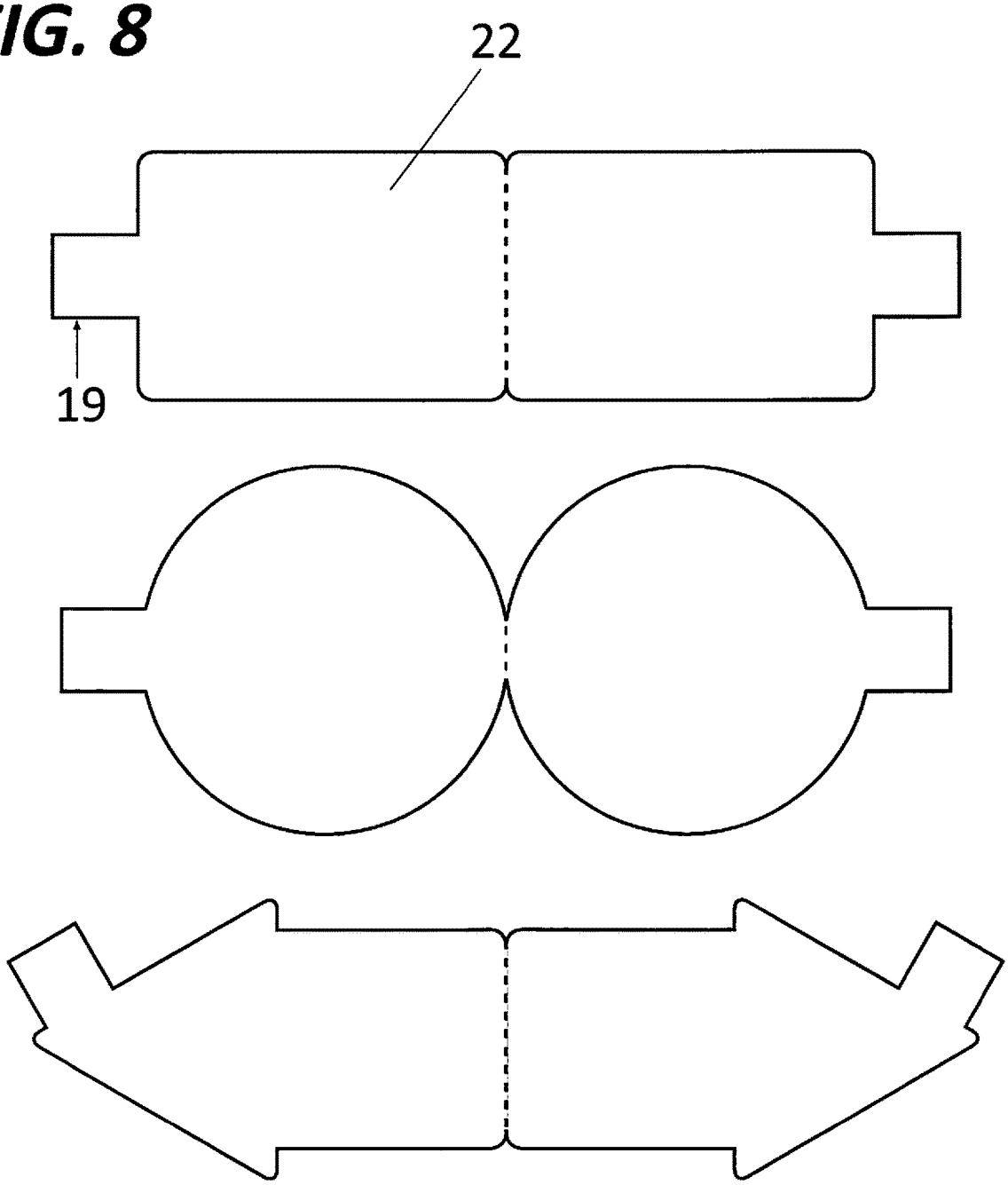
FIG. 8 is an example of other flag shapes that may be printed on the sheet.
Figure 9:
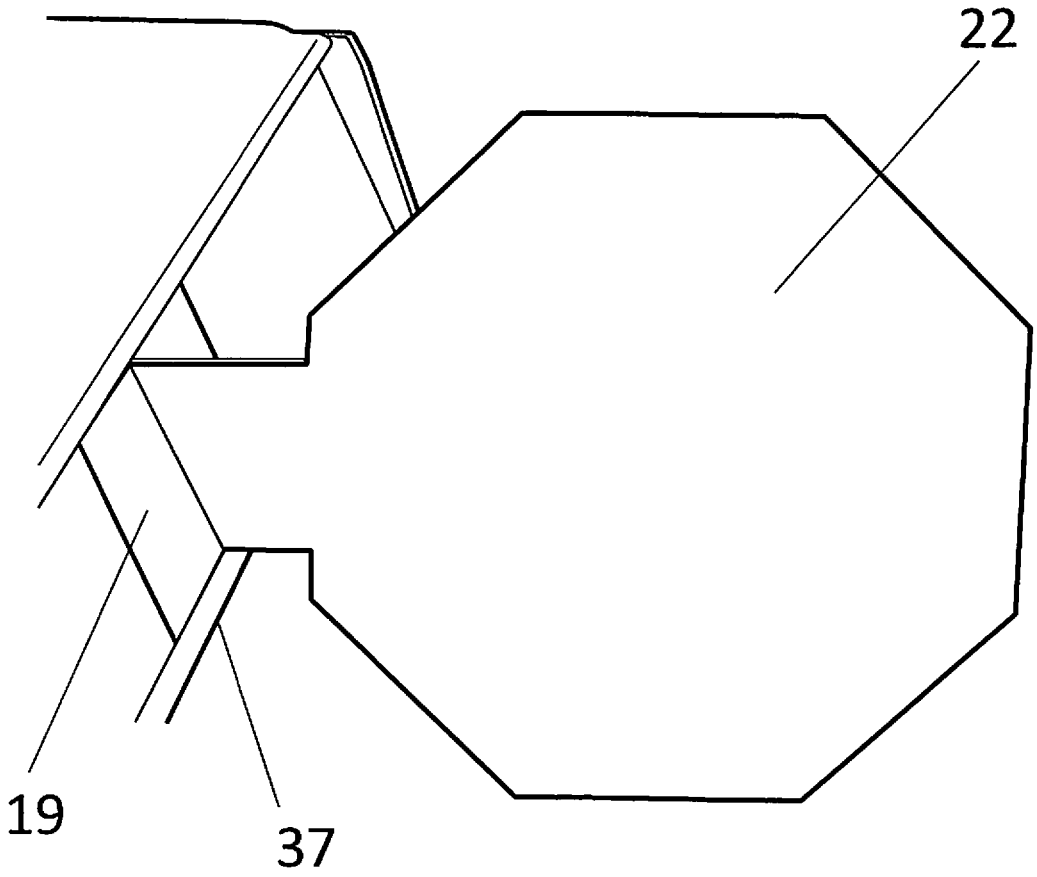
FIG. 9 is an embodiment of a flag design in which the tabs bend away from one another for insertion along a retail shelf edge or adhesion to it.
Figure 10:
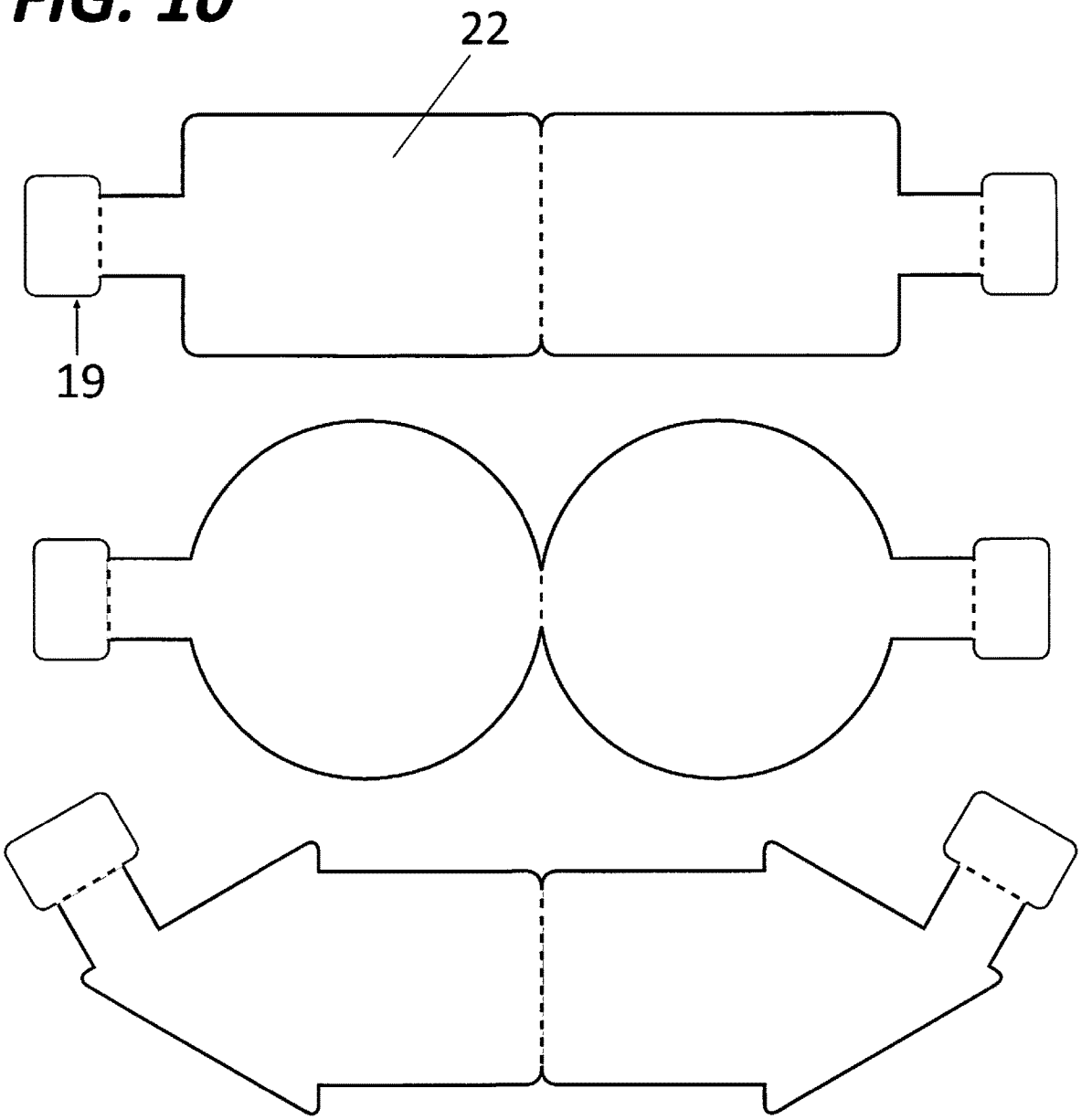
FIG. 10 is an embodiment of flag designs that include tabs that may bend away from one another.
Figure 11:
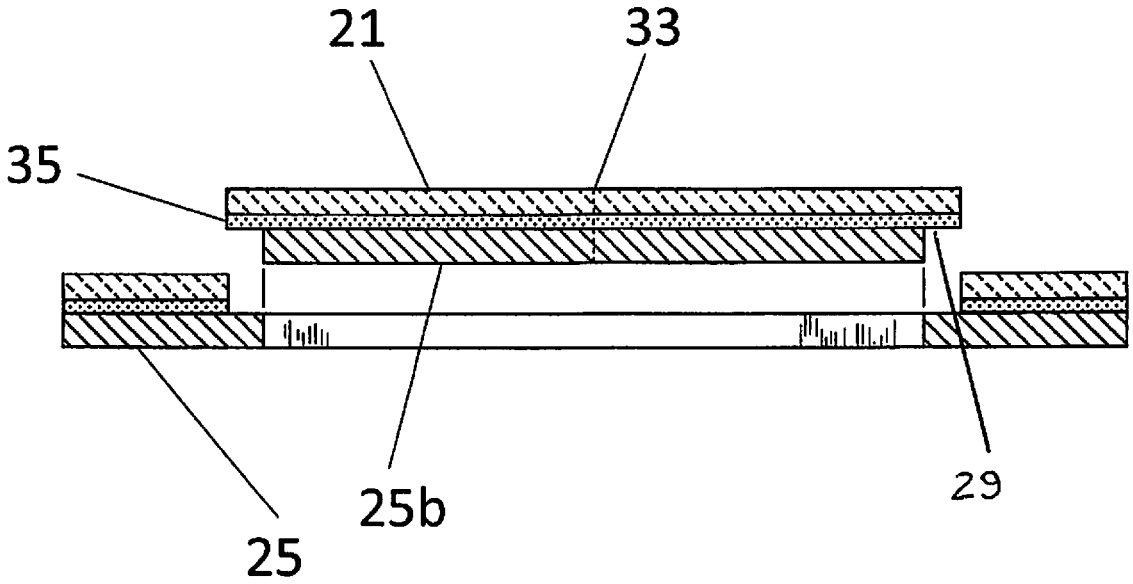
FIG. 11 is a cross-section view of a flag when removed from the printed sheet.
Figure 12:
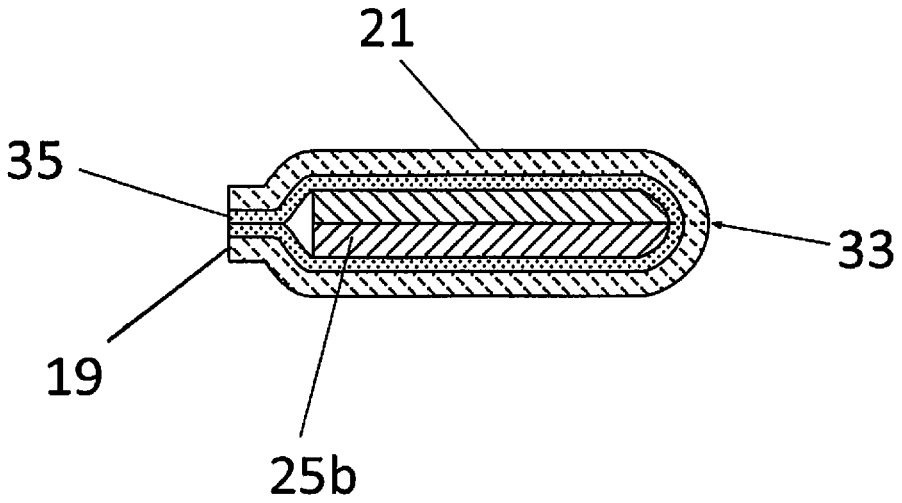
FIG. 12 is a cross-section view of a flag when folded over and the two sides adhered to one another.

The pop-out design eliminates the labor and other difficulties associated with perforated flag designs. The pop-out design also allows for reliable laser printing feed path integrity and strength, with the liner 25 remaining with the face stock 21 to add necessary stiffness to the flag 10 when installed (see e.g. FIG. 6). Adjacent flags 10 on the printed sheet 20 are separated by space from one another.

Figure 3:
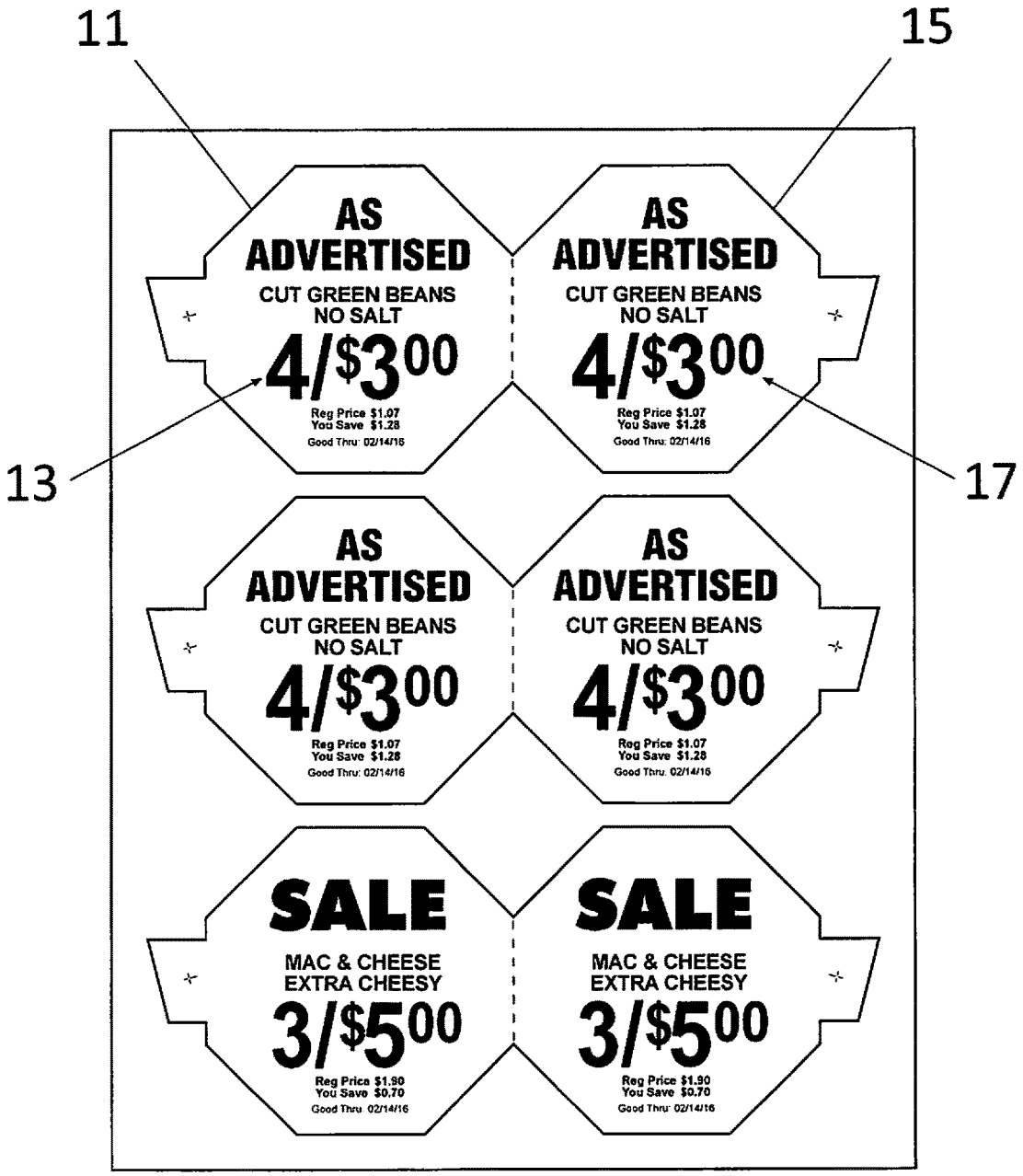
FIG. 3 is an embodiment of the digitally printed sheet.
Figure 4:
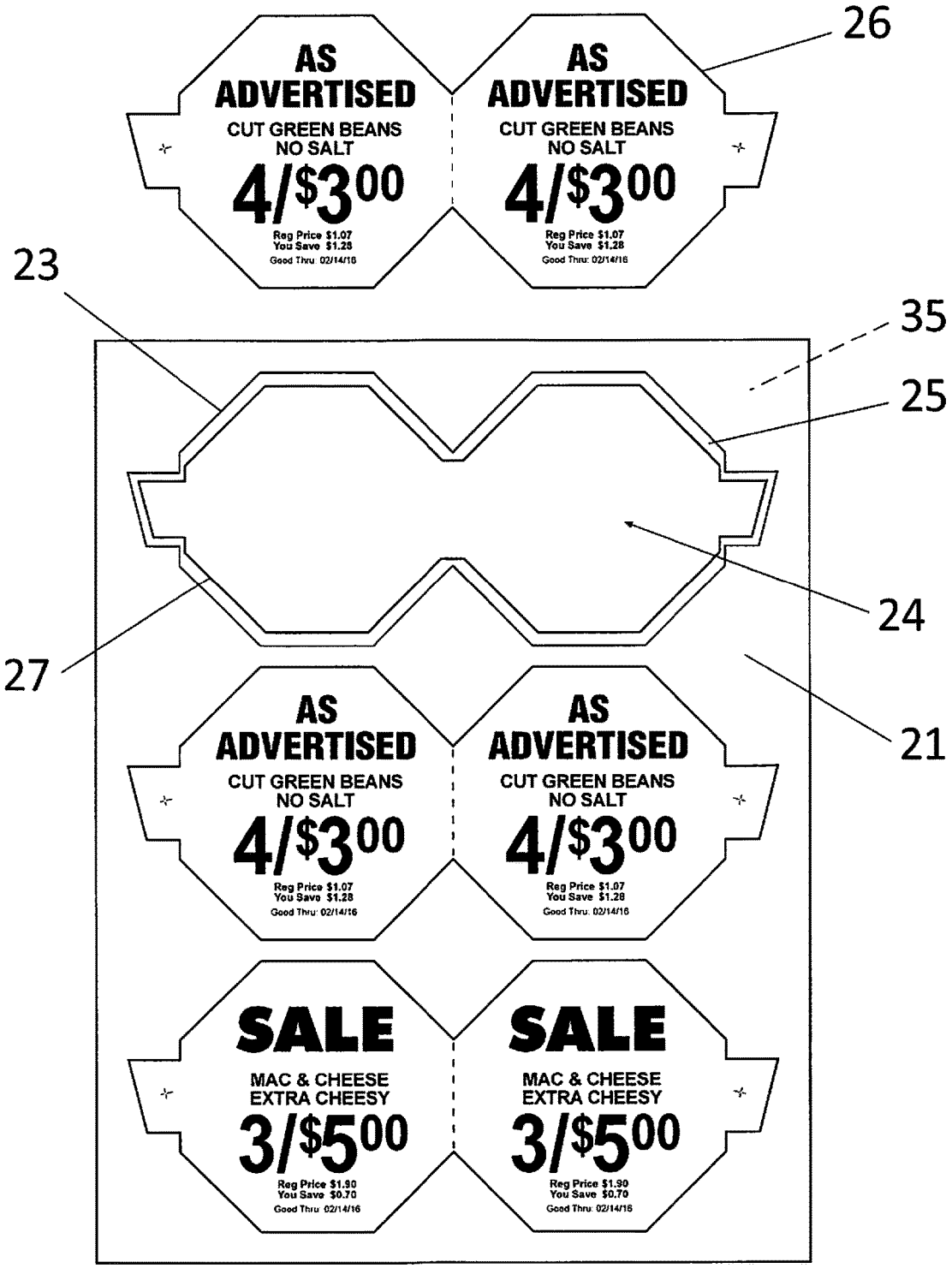
FIG. 4 is an embodiment of a printed flag when removed from the sheet. The pop-out design makes it easy to remove the flag from the sheet without the labor associated with perforated tear-down flags.
Figure 5:
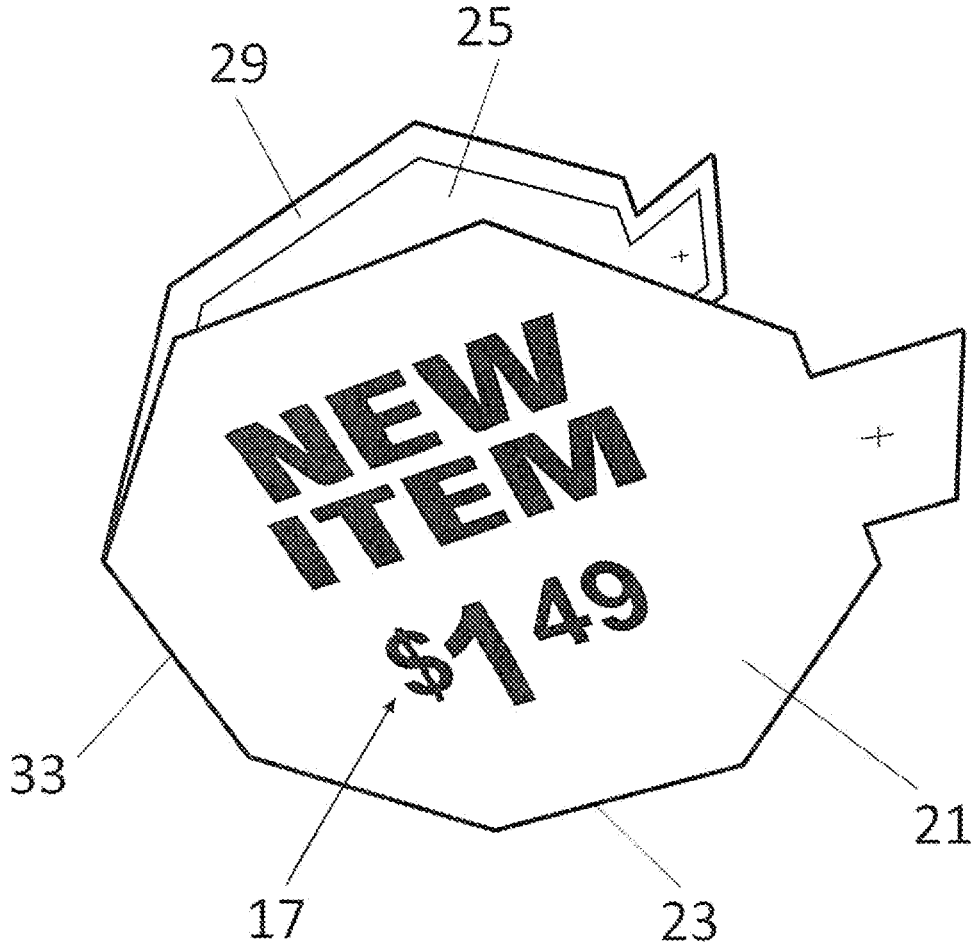
FIG. 5 is an embodiment of the removed flag with its exposed adhesive being folded on itself.
Figure 13:
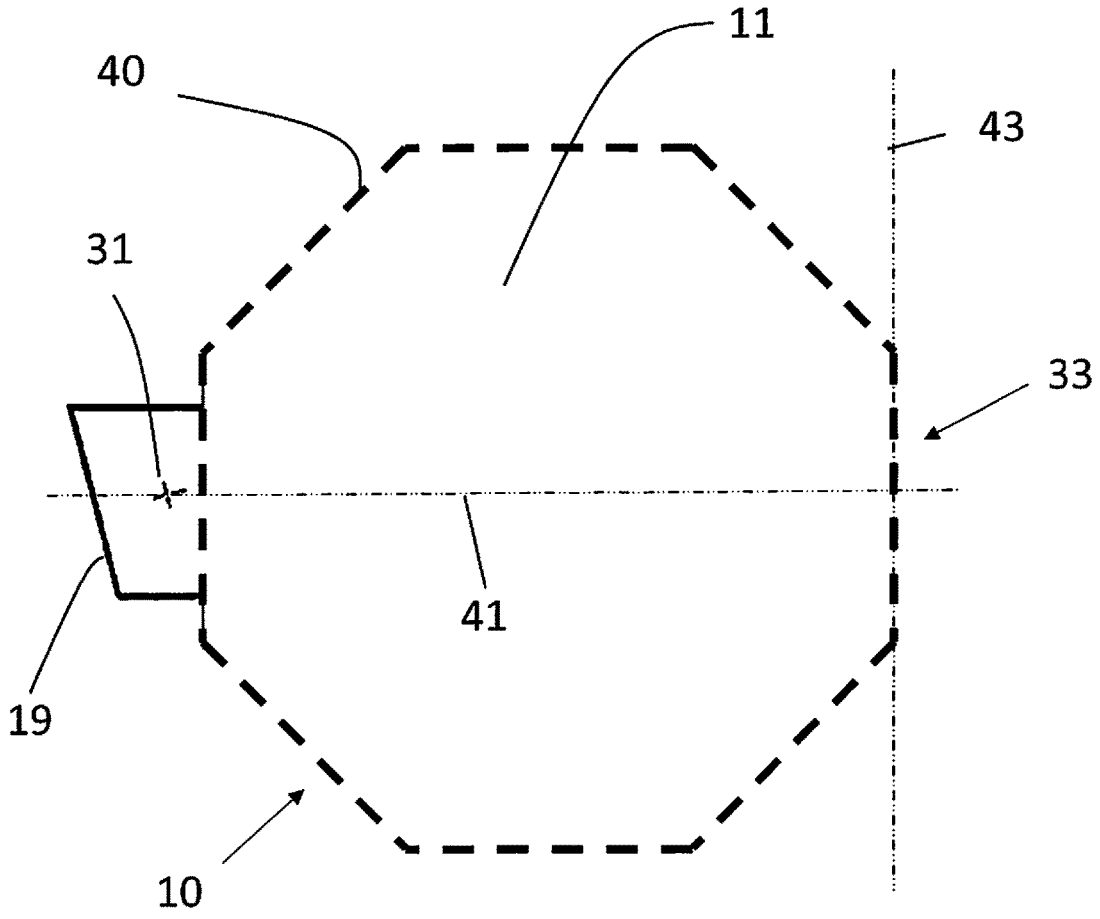
FIG. 13 is an illustration of a predetermined geometric shape (shown in dashed lines) of the flag that is formed by the front and back sides of the flag when in a folded state and adhered to one another. A tab extends outward of the geometric shape for retention by a retail shelf clip.

The flag design, which can be any suitable shape 40 (e.g., square, rectangular, circular, polygonal-shaped other than square or rectangular), is arranged on the sheet 20 so that the front and back information 13, 17 on the flag 10 is printed in a side-by-side format, separated by a crease cut or perforated cut 33 through the liner 25. This eliminates the need to duplex the sheet 20 in the printer. The front and back sides 11, 15 of the flag 10 each provide an uninterrupted solid surface within the shape 40 on which to print the front and back information 13, 17. See e.g. FIGS. 3, 5, & 13. The flag 10 may also include fixed information 12, 16, which may be pre-printed by a printer using the printer's printer and a user later adding the variable information 13, 17 using the user's printer. Adjacent flags 10 may be separated by space from one another on the sheet 20.

When the flag 10 is removed from (popped-out of the sheet 20), a void area 24 is left on the sheet 20. The exposed adhesive trim 29 on the front 11 and back 15 of the flag 10 sticks to itself when the flag 10 is folded on itself. In this way, the flag 10 does not bow out when assembled like traditional folded cardstock, but instead remains flat and stuck to itself. When in this folded state the front and back sides 11, 15 define a predetermined geometric shape 40 of the flag 10 and the tab 19 extends outward of the geometric shape 40. See e.g. FIGS. 3, 5, 12, & 13.

A tab 19 extends from a print area 22 of each side 11, 15 of the flag 10. The tab 19 is smaller in width and height than that of the print area 22. A perforated hole or t-shaped or cross-shaped cut 31 may be included in the tab 19 to allow the shelf clip 38 to pierce the folded hanging tab 19. In other embodiments, the tab 19 may be bent for retention along a retail shelf edge 37. In embodiments the tab 19 is located opposite the fold line 33 and along a horizontal centerline 41 of the flag 10, the fold line 33 being located along the vertical centerline 43 when unfolded, where horizontal and vertical are determined by the intended correct orientation of the flag 10 when connected to a retail shelf clip 38. See e.g. FIGS. 6 & 13. The t-shaped or cross-shaped cut 31 may be located along the horizontal centerline 41 as it passes through the tab 19.

Figure 14:
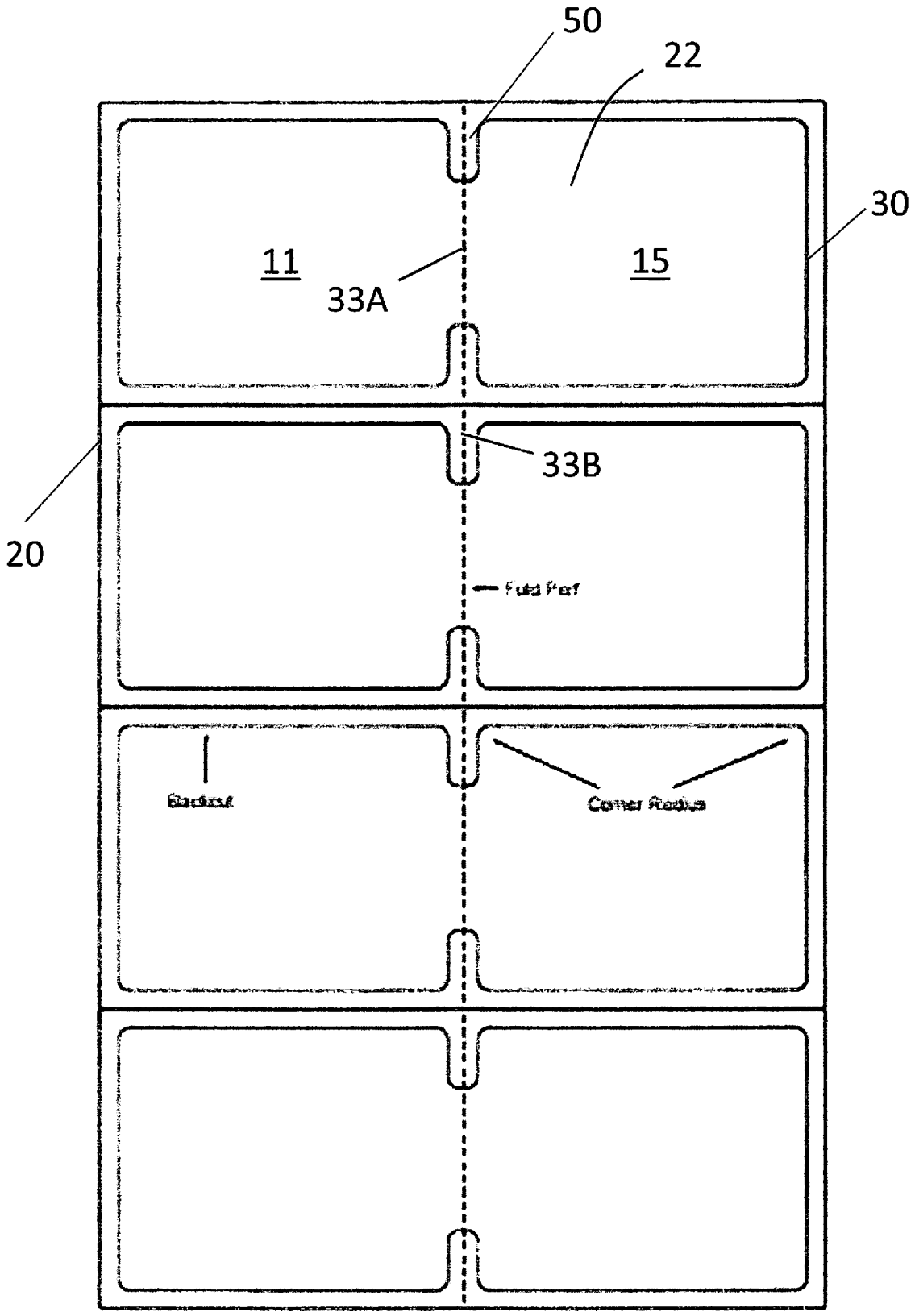
FIG. 14 is another embodiment of the laser printer printable flag arranged on a laser printable sheet. The flag includes a relief that prevents the flag from bunching or swelling at places along the perimeter—which creates a void or bubble at or toward the fold line—when the flag is folded over, and the two sides are adhered to one another. Instead, the sides remain in contact with one another along the entire perimeter of the folded flag.
Figure 15A:
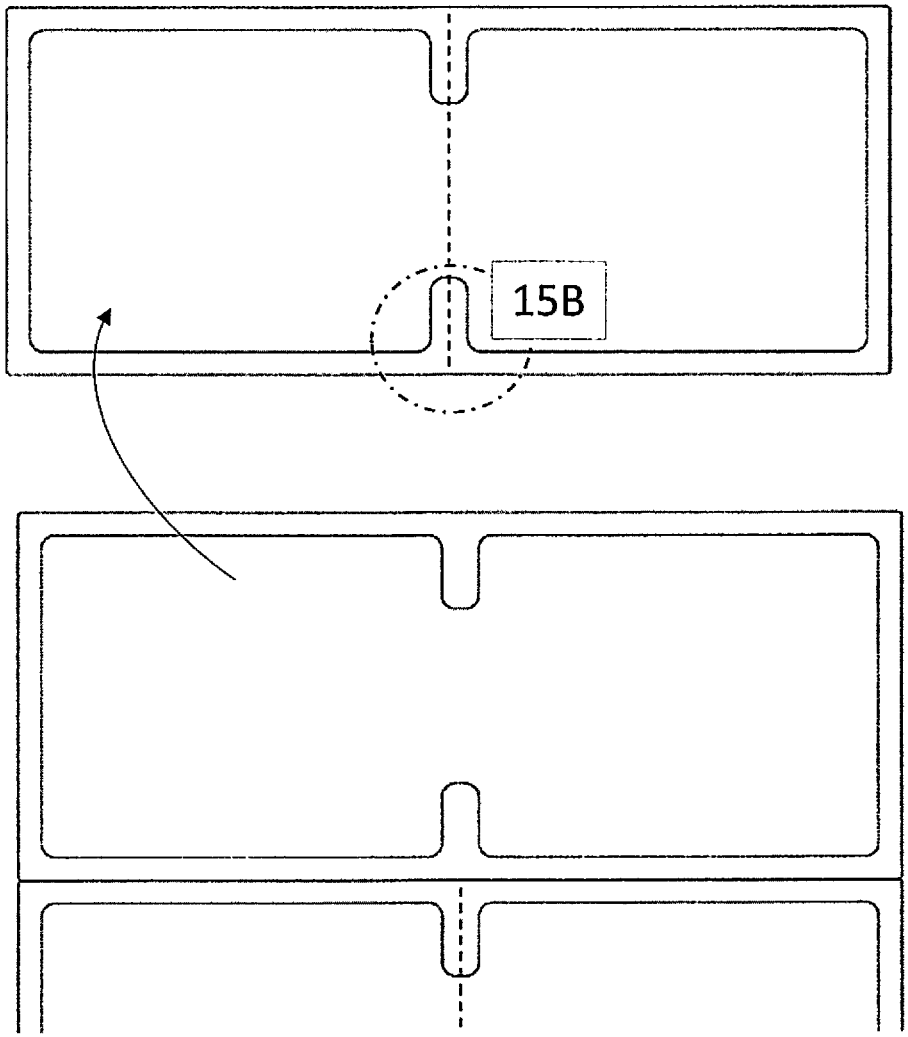
FIG. 15A is view of a flag when cut or detached from the larger printed sheet.
Figure 15B:
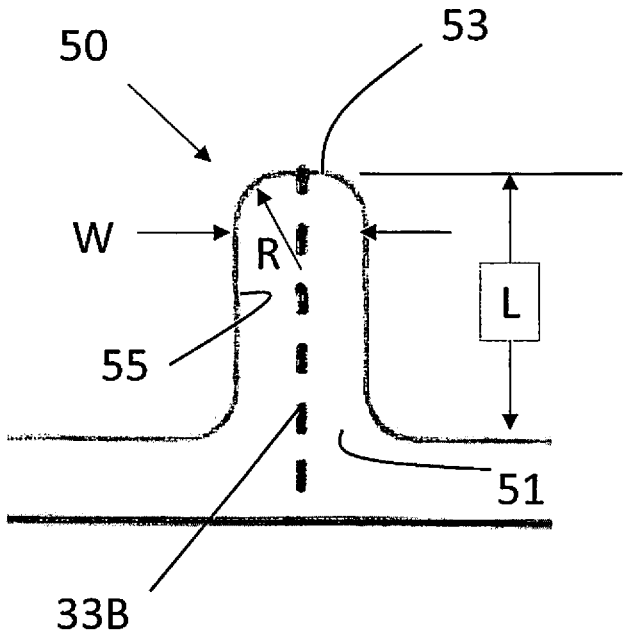
FIG. 15B is an enlarged view of section 15A.
Figure 16:
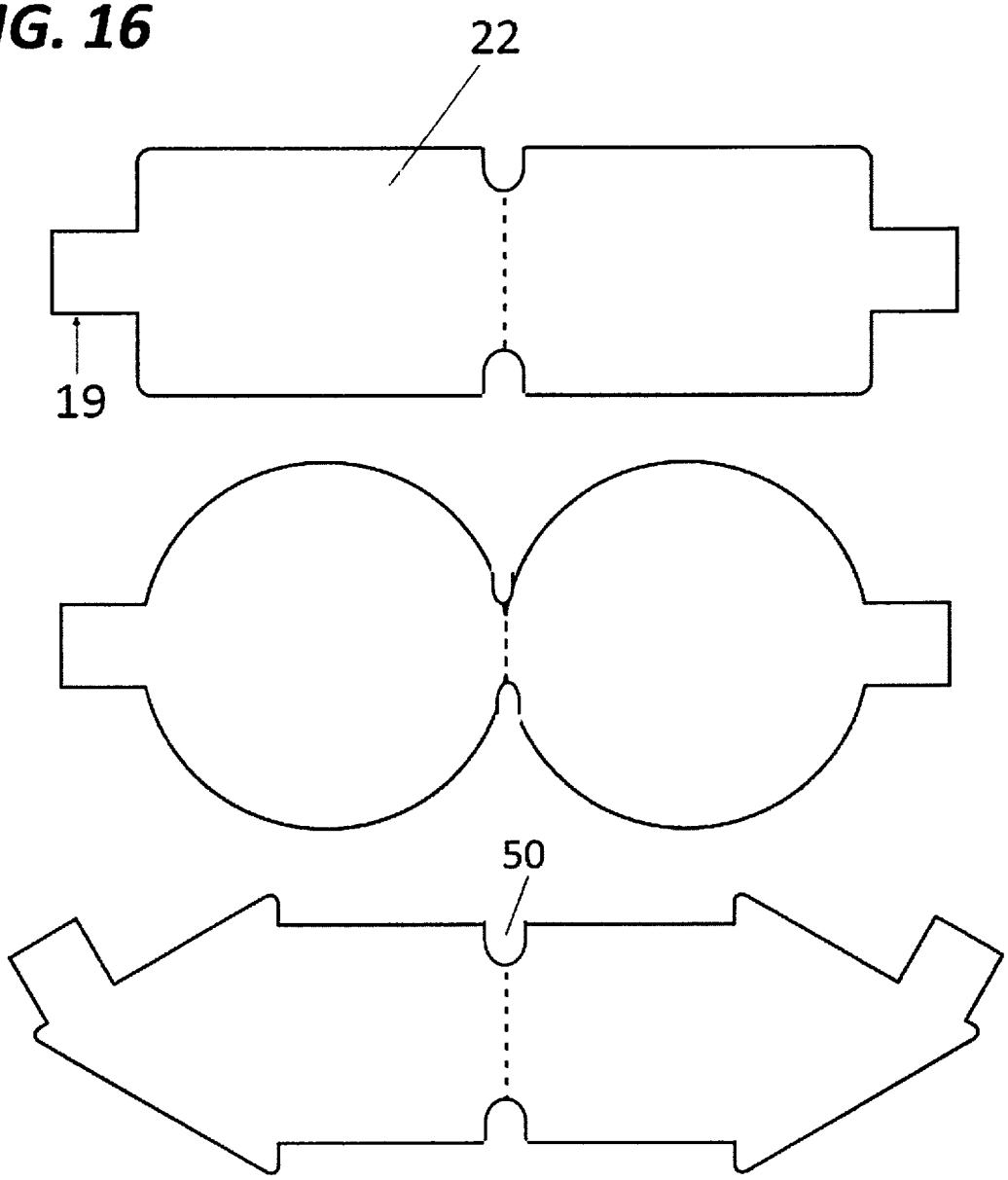
FIG. 16 presents examples of other geometric shapes of the flag that include the relief. The flags are shown in an unfolded state.

Referring now to FIGS. 14-16, embodiments of a flag 10 of this disclosure may include a relief 50 that compensates for the pressure of the two sides 11, 15 folding onto one another by moving the liner back. This eliminates a "void of touching" along the perimeter 30 at or near (about ⅓", ¼", ⅛") the fold line 33, which serves as a registration to keep the sides 11, 15 straight when folded onto one another. The sides 55 of the relief 50 may run substantially parallel to the fold line 33. The relief 50 includes a first (open) end 51 and arcuate shaped (closed) second end 53. The fold line 33 includes a bi-level perforated cut 33A between opposing ends 53 and a face cut only perforation 33B where the fold line 33 overlaps the relief 50.

End 53 may have a predetermined radius "R", a width "W", and a length "L". In some embodiments the length L may be twice that of the width W. Relative to the overall size of the flag 10, the width W may in a range of 5% to 10% of the overall length of the flag 10 (when unfolded) and the length L may be in a range of 15% to 25% of the total height of the flag 10. The flag 10 may be a vinyl material. The flag design may be any suitable geometric shape (e.g., square, rectangular, circular, polygonal-shaped other than square or rectangular). In some embodiments, the flag 10 may include a tab extending outward of the geometric shape in addition to the relief 50.

While embodiments of a printable sheet containing a flag for a retail shelf fixture have been described and illustrated, modifications apart from those shown or suggested here may be made without departing from the scope of the following claims. The terms that are employed in the claims draw their meaning from the use of the terms in the specification. The same terms employed in the prior art may be broader in meaning than specifically employed here. Whenever there is a question between the broader definition of such terms used in the prior art and the more specific use of the terms herein, the more specific meaning is meant.

What is claimed:

1. A printable sheet comprising:

a plurality of retail shelf edge perpendicular flags, each flag of the plurality including:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet along the face cut;

the first and second sides each containing a print area including a pair of opposing concave-shaped reliefs located coaxial to the fold line and a tab extending outward of the print area, each relief including an open first end and an arcuate-shaped closed second end contacting the fold line;

the fold line including a bi-level perforated cut between the second closed ends of the opposing concave-shaped reliefs and a face cut only perforation where the fold line overlaps each concave-shaped relief;

wherein in a folded state the first and second sides adhere to one another along the exposed adhesive border and define a predetermined geometric shape of the flag, the tab extending outward of the predetermined geometric shape, each of the sides being an uninterrupted solid surface within the predetermined geometric shape.

2. The printable sheet of claim 1, the print area including a first and a second different set of information, the first set of information being printed by a first printer and the second different set of information being printed by a second different printer.

3. The printable sheet of claim 1, wherein the exposed adhesive border of the first side comes into contact with the exposed adhesive border of the second side when the flag is folded onto itself along the fold line.

4. The printable sheet of claim 1, the fold line being selected from the group consisting of a crease cut and a perforated cut.

5. The printable sheet of claim 1, the fold line being a bi-level perforated cut between the opposing reliefs.

6. The printable sheet of claim 1, wherein the predetermined geometric shape is polygonal shaped or circular shaped.

7. The printable sheet of claim 1, further comprising, the tab including a cross-shaped perforation.

8. The printable sheet of claim 7, the cross-shaped perforation moving between a perforated state and a punctured state including a hole when the tab is connected to a retail shelf edge.

9. The printable sheet of claim 1, wherein, sides of each concave-shaped relief run parallel to the fold line.

10. A method of making a retail shelf edge perpendicular flag, the method comprising:

providing a printable sheet that contains a plurality of retail shelf perpendicular flags removeable from the printable sheet wherein at least two adjacent flags of the plurality are separated by space on the printed sheet, wherein each flag of the plurality includes:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet along the face cut;

the first and second sides each containing a print area including a pair of opposing concave-shaped reliefs located coaxial to the fold line and a tab extending outward of the print area, each relief including an open first end and an arcuate-shaped closed second end contacting the fold line;

the fold line including a bi-level perforated cut between the second closed ends of the opposing concave-shaped reliefs and a face cut only perforation where the fold line overlaps each concave-shaped relief;

wherein in a folded state the first and second sides adhere to one another along the exposed adhesive border and define a predetermined geometric shape of the flag, the tab extending outward of the predetermined geometric shape, each of the sides being an uninterrupted solid surface within the predetermined geometric shape.

11. The method of claim 10, further comprising printing on the print area a second set of information different than the first set of information.

12. The method of claim 11, wherein the second set of information is printed by a second different printer.

13. The method of claim 10, further comprising:

removing a flag from the printed sheet to expose an adhesive border of the first side and an adhesive border of the second side; and folding the flag onto itself so the exposed adhesive borders come into contact with one another.

14. The method of claim 13, further comprising connecting the tab to a retail shelf edge.

15. The method of claim 10, wherein, sides of each concave-shaped relief run parallel to the fold line.

16. A printable sheet comprising:

a plurality of retail shelf edge perpendicular flags, each flag of the plurality including:

a first and a second side in an unfolded state arranged adjacent one another on a face stock side of the printable sheet and sharing a fold line connecting said sides to one another;

a face die cut around a perimeter of the first and second sides to an adhesive layer of the printable sheet; and a back die cut through a liner of the sheet, the back die cut having a perimeter smaller than that of the face die cut to provide an exposed adhesive border around the liner when the flag is removed from the printable sheet along the face cut;

the first and second sides each containing a print area including a pair of opposing concave-shaped reliefs located coaxial to the fold line and a tab extending outward of the print area, each relief including an open first end and an arcuate-shaped closed second end contacting the fold line and sides of each concave-shaped relief running parallel to the fold line;

wherein in a folded state the first and second sides adhere to one another along the exposed adhesive border and define a predetermined geometric shape of the flag, the tab extending outward of the predetermined geometric shape, each of the sides being an uninterrupted solid surface within the predetermined geometric shape.

17. The printable sheet of claim 16, further comprising, the fold line including a bi-level perforated cut between the second closed ends of the opposing concave-shaped reliefs and a face cut only perforation where the fold line overlaps each concave-shaped relief.

* * * * *